US010400786B2

(12) United States Patent
Wusatowska-Sarnek et al.

(10) Patent No.: US 10,400,786 B2
(45) Date of Patent: Sep. 3, 2019

(54) COATED TURBOMACHINERY COMPONENT

(71) Applicant: United Technologies Corporation, Farmington, CT (US)

(72) Inventors: Agnieszka M. Wusatowska-Sarnek, Mansfield Center, CT (US); Sergei F. Burlatsky, West Hartford, CT (US); David Ulrich Furrer, Marlborough, CT (US); J. Michael McQuade, Avon, CT (US)

(73) Assignee: United Technologies Corporation, Farmington, CT (US)

( * ) Notice: Subject to any disclaimer, the term of this patent is extended or adjusted under 35 U.S.C. 154(b) by 338 days.

(21) Appl. No.: 15/344,638

(22) Filed: Nov. 7, 2016

(65) Prior Publication Data

US 2018/0128284 A1 May 10, 2018

(51) Int. Cl.
*F04D 29/38* (2006.01)
*F01D 5/28* (2006.01)
(Continued)

(52) U.S. Cl.
CPC ..... *F04D 29/388* (2013.01); *F01D 5/20* (2013.01); *F01D 5/288* (2013.01); *F01D 11/122* (2013.01); *F04D 29/023* (2013.01); *F04D 29/164* (2013.01); *F04D 29/327* (2013.01); *F04D 29/526* (2013.01); *F05D 2220/32* (2013.01); *F05D 2230/53* (2013.01);
(Continued)

(58) Field of Classification Search
CPC ..... F01D 5/20; F01D 5/288; F01D 11/122; F05D 2300/516; F05D 2300/609; F05D 2300/611
See application file for complete search history.

(56) References Cited

U.S. PATENT DOCUMENTS 3,199,836 A 8/1965 Moyer
7,425,115 B2 9/2008 Johnson et al.
(Continued)

FOREIGN PATENT DOCUMENTS

EP 2573326 A1 3/2013
EP 3056679 A1 8/2016
(Continued)

OTHER PUBLICATIONS

European search report for patent application No. 17200460.8-1006 dated Mar. 27, 2018.

*Primary Examiner* — Dwayne J White
*Assistant Examiner* — Jackson N Gillenwaters
(74) *Attorney, Agent, or Firm* — Bachman & LaPointe, PC

(57) ABSTRACT

A rotor for a turbomachine is provided which includes a hub; and a plurality of blades extending radially from the hub, the plurality of blades comprising a first subset of blades having first tips and an abrasive coating on the first tips, and a second subset of blades having second tips with no abrasive coating on the second tips, wherein a radius ($R_2$) of the first subset of blades, including thickness of the abrasive coating, is greater than a radius ($R_1$) of the second subset of blades, and wherein a base radius (R) of the first subset of blades, not including thickness of the abrasive coating, is less than the radius ($R_1$) of the second subset of blades.

17 Claims, 6 Drawing Sheets

(51) Int. Cl.

| | |
|---|---|
| ***F01D 11/12*** | (2006.01) |
| ***F04D 29/02*** | (2006.01) |
| ***F04D 29/16*** | (2006.01) |
| ***F04D 29/52*** | (2006.01) |
| ***F01D 5/20*** | (2006.01) |
| ***F04D 29/32*** | (2006.01) |

(52) U.S. Cl.
CPC .... *F05D 2230/90* (2013.01); *F05D 2240/307* (2013.01); *F05D 2300/609* (2013.01); *F05D 2300/611* (2013.01)

(56) References Cited

U.S. PATENT DOCUMENTS

| | | | | |
|---|---|---|---|---|
| 2003/0183529 | A1 | 10/2003 | Ohara et al. | |
| 2004/0096318 | A1* | 5/2004 | Ohara | C25D 15/02 415/173.4 |
| 2013/0078084 | A1* | 3/2013 | Gendrich | F01D 5/20 415/173.1 |

FOREIGN PATENT DOCUMENTS

| | | | |
|---|---|---|---|
| GB | 2 225 388 | A | 5/1990 |
| WO | 2004090290 | A2 | 10/2004 |

* cited by examiner

COATED TURBOMACHINERY COMPONENT

BACKGROUND

The present disclosure is directed to turbomachinery and, more particularly, to turbomachine components having abrasive coatings.

Turbomachinery, such as gas turbine engines, have rotors with one or more rows of rotating blades. Radially outward tips of the blades are located in close proximity to a typically stationary surface which is, or acts as, a seal. To maximize engine efficiency, leakage of gas or other working fluid around the blade tips should be minimized. This may be achieved by configuring the blade tips and seal such that they contact each other during periods of operation of the turbomachine, such as during initial operation of the turbomachine referred to as the green run, during normal operation, and possibly during other operating conditions such as a bird strike. With such a configuration, the blade tips act as an abrading component and the seal can be provided as an abradable seal. Generally, the blade tip is harder and more abrasive than the seal. Thus, the blade tips will abrade or cut into the abradable seal during those portions of the engine operating cycle when the blade tip comes into contact with the abradable seal. This interaction between blade tips and seal is desirable as it helps to provide minimal leakage between blade tips and seal.

Since gas turbine engines, such as aircraft gas turbine engines, experience cyclic mechanical and thermal load variations during operation, their geometry varies during different stages of the operating cycle. Thus, the blade tips should retain their cutting capability over many operating cycles compensating for any progressive changes in gas turbine engine geometry.

During certain engine operating conditions, such as during a bird strike or engine surge, gas turbine engines have shown high radial interaction rates between the blade tips and abradable seals (~40"/s) that can cause rapid depletion of the abrasive blade tip coating when rubbed against the abradable seals. Low radial interaction rates, which occur during certain engine operating conditions such as during low transient thermal or mechanical loading cycles (for example during the green run), can also result in excessive wear and damage to abradable seals through the generation of large thermal excursion within the seal system (abrasive tip and abradable seal).

If the abrasive coating on the blade tip is depleted, unwanted sliding contact or rubbing of the base material of the blade tip, such as titanium, nickel, steel, and aluminum alloys, and the abradable seal may occur. This results in direct contact between the base material of the blade tip and the abradable seal. Contact of base material with the abradable seal can cause unwanted conditions within the gas turbine engine.

An alternative blade tip and seal configuration is needed for enabling reduced clearance during normal running and other transient conditions, while addressing the above-described issues.

SUMMARY

In accordance with the present disclosure, there is provided a rotor for a turbomachine, comprising a hub; and a plurality of blades extending radially from the hub, the plurality of blades comprising a first subset of blades having first tips and an abrasive coating on the first tips, and a second subset of blades having second tips with no abrasive coating on the second tips, wherein a radius ($R_2$) of the first subset of blades, including thickness of the abrasive coating, is greater than a radius ($R_1$) of the second subset of blades, and wherein a base radius (R) of the first subset of blades, not including thickness of the abrasive coating, is less than the radius ($R_1$) of the second subset of blades.

In a further exemplary embodiment, there is provided a turbomachine comprising a rotor comprising a hub; a plurality of blades extending radially from the hub, the plurality of blades comprising a first subset of blades having first tips and an abrasive coating on the first tips, and a second subset of blades having second tips with no abrasive coating on the second tips, wherein a radius ($R_2$) of the first subset of blades, including thickness of the abrasive coating is greater than a radius ($R_1$) of the second subset of blades, and wherein a base radius (R) of the first subset of blades, not including thickness of the abrasive coating, is less than the radius ($R_1$) of the second subset of blades; and an abradable surface opposed to tips of the plurality of blades, wherein the surface comprises an abradable material.

In a further exemplary embodiment, the surface has an inner radius ($R_3$) which is substantially equal to the radius ($R_2$) of the first subset of blades including thickness of the abradable coating.

In a further exemplary embodiment, the abrasive coating and the abradable material define a rub couple which maintains a worn radius ($R_2'$) of the first subset of blades, including thickness of the abrasive coating, greater than the radius ($R_1$) of the second subset of blades through a useful lifetime of the rotor.

In a further exemplary embodiment, the abrasive coating comprises a matrix and particles of grit in the matrix, the particles having a determined grit size distribution and an average grit size, and wherein a combination of the base radius (R) of the first subset of blades and a grit particle having a particle size of $+2\sigma$ of the average grit size is substantially equal to the radius ($R_2$) of the first subset of blades including thickness of the abrasive coating. In this regard, $\sigma$ is one standard deviation in particle size of the grit.

In a further exemplary embodiment, a combination of the base radius (R) of the first subset of blades and a grit particle having a particle size of $-2\sigma$ of the average grit size is greater than or equal to the radius ($R_1$) of the second subset of blades.

In a further exemplary embodiment, the particles of grit are selected from the group consisting of CBN, alumina powder, zirconia powder, coated silicon carbide (SiC), ceramic powder, other hard ceramic phase, sprayed oxides and combinations thereof.

In a further exemplary embodiment, grit size distribution is between 5 microns and 350 microns.

In a further exemplary embodiment, the rotor is a monolithic structure comprising the plurality of blades integrally formed with the hub.

In a still further exemplary embodiment, there is provided a method for making a rotor for a turbomachine, comprising providing a rotor comprising a hub and a plurality of blades extending from the hub, said plurality of blades comprising a first subset of blades having first tips and a second subset of blades having second tips, wherein a base radius (R) of the first tips is less than a radius ($R_1$) of the second tips; and applying an abrasive coating to the first tips such that a radius ($R_2$) of the first subset of blades including thickness of the abrasive coating is greater than the radius ($R_1$) of the second subset of blades.

DETAILED DESCRIPTION

Figure 1:
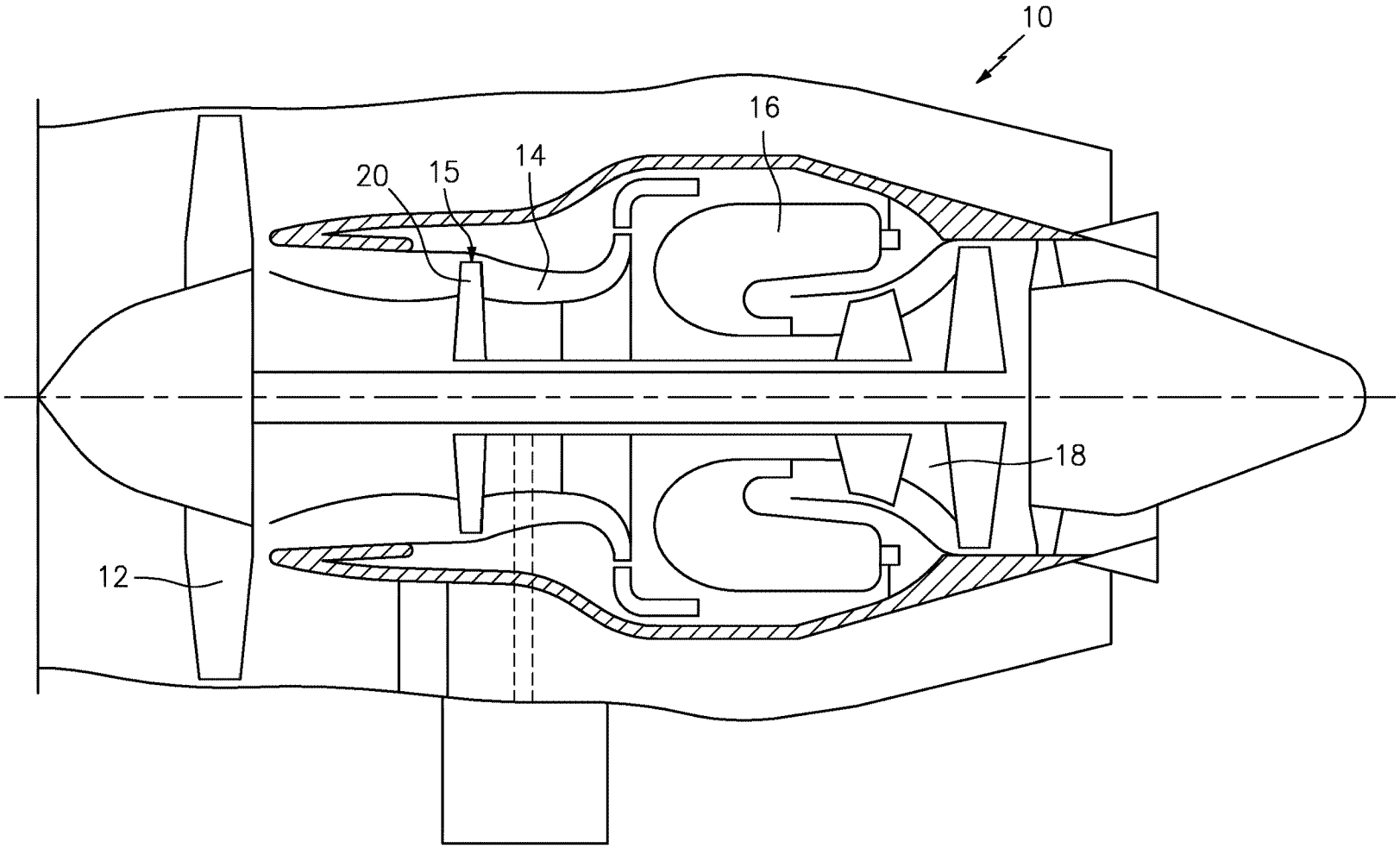
FIG. 1 is a schematic cross-sectional view of a turbofan gas turbine engine.

FIG. 1 illustrates a turbomachine in the form of a gas turbine engine 10, of a type provided for use in subsonic and/or supersonic flight, generally comprising in serial flow communication a fan section having fan blades 12 through which ambient air is propelled, a compressor section 14 for pressurizing the air, a combustor 16 in which the compressed air is mixed with fuel and ignited for generating hot combustion gases, and a turbine section 18 for extracting energy from the combustion gases. The compressor section 14 in an exemplary embodiment is an axial compressor section, and includes one or more stages 15, each stage 15 having a rotor 20. Although a turbofan engine is depicted and described herein, it will be understood that the present disclosure relates broadly to various embodiments of turbines and compressors such as turbo-shafts, turbo-props, turbojets or auxiliary power units, as non-limiting examples.

The disclosure relates to application of abrasive coatings to the tips of blades of rotor 20 of a turbomachine, as well as a system including such a rotor and a corresponding abradable surface, and a method for making such a rotor.

Figure 2:
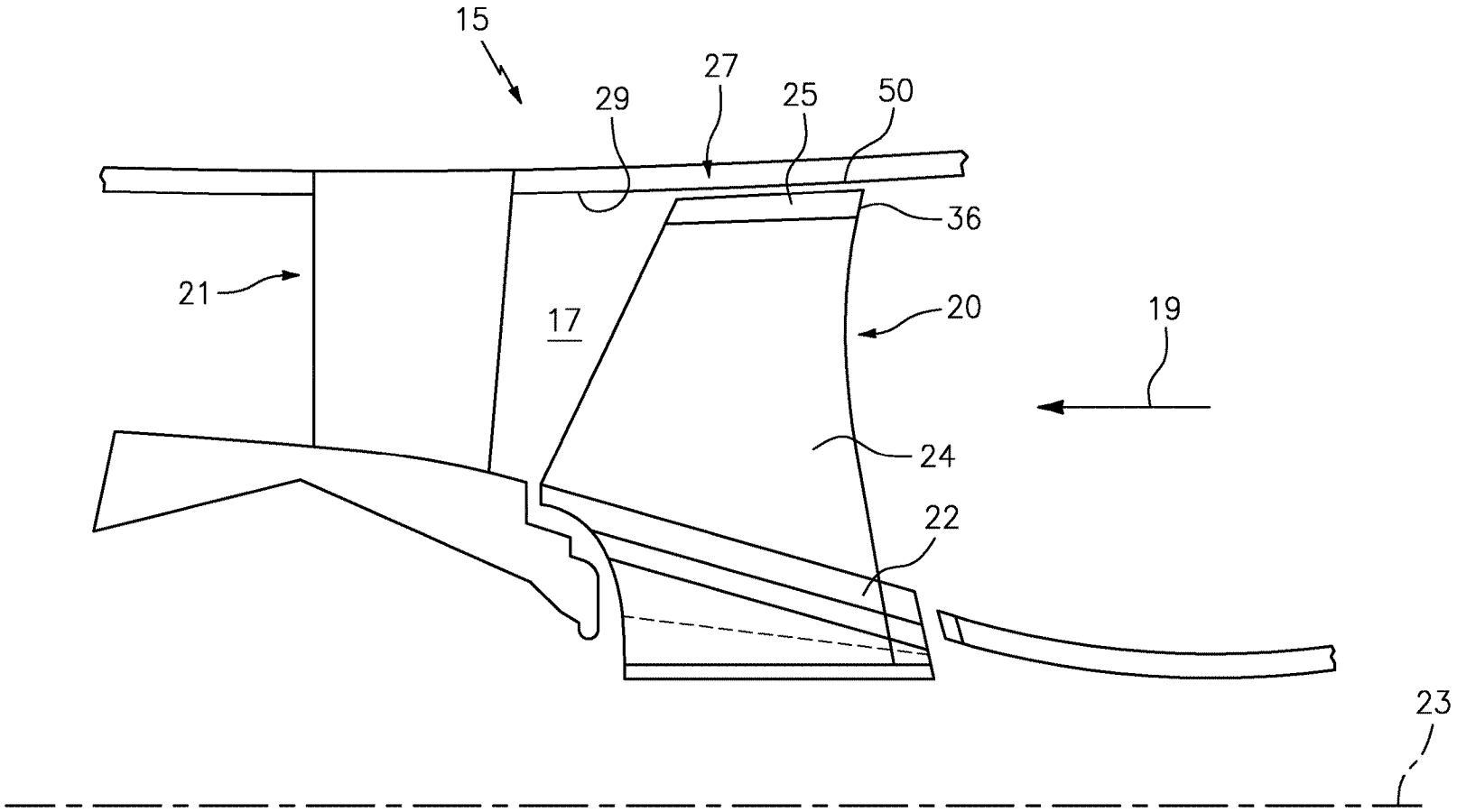
FIG. 2 is a partial cross-sectional view of an axial compressor of the gas turbine engine of FIG. 1.

FIG. 2 illustrates further detail of a stage 15 of the compressor section 14 of the gas turbine engine 10 which generally comprises rotor 20 and a stator 21 downstream relative thereto, each rotor 20 and stator 21 having a plurality of blades disposed within the gas flow path 17 (the gas path including the compressor inlet passage upstream of the compressor section 14 and the compressor discharge passage downstream of the compressor section 14). Gas flowing in direction 19 is accordingly fed to the compressor section 14 via the compressor inlet passage of the gas flow path 17 and exits therefrom via the compressor discharge passage.

Rotor 20 rotates about a central axis of rotation 23 within a stationary and circumferentially extending outer casing or shroud 27, the radially inwardly facing wall 29 of which defines a radial outer boundary of the annular gas flow path 17 through the compressor section 14. As will be described in further detail below, rotor 20 includes a central disc or hub 22 and a plurality of blades 24 radially extending therefrom and terminating in blade tips 25 immediately adjacent outer shroud 27.

Rotors such as rotor 20 can be of any variety of rotor, with one exemplary embodiment being an integrally-bladed rotor (IBR). IBRs are formed of a unitary or monolithic construction, wherein the radially projecting rotor blades are integrally formed with the central hub. Although the present disclosure will focus on an axial compressor rotor that is an IBR, it is to be understood that the presently described configuration could be equally applied to other types of rotor such as impellors (i.e. centrifugal compressors) which may or may not be IBRs, to IBR fans, or to other rotors used in the compressor or turbine of a gas turbine engine.

As will be further discussed below, some but not all of the fan blades 12 can be provided with an abrasive coating 36, which interacts with an abradable seal 50.

Figure 3:
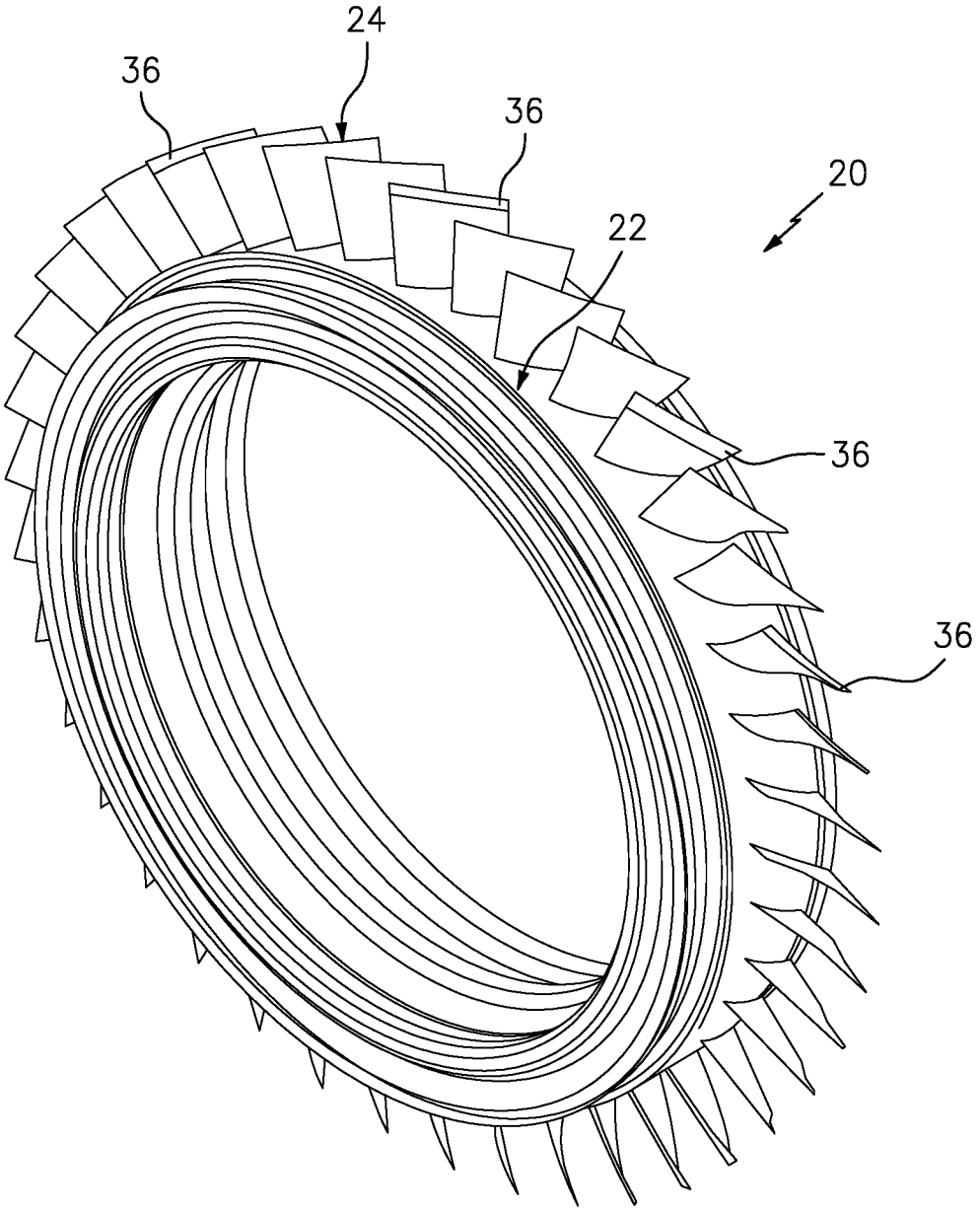
FIG. 3 is a perspective view of a rotor of the axial compressor of FIG. 2, shown in partial transparency for ease of explanation only.

Referring now to FIG. 3, an exemplary rotor 20 is illustrated having central hub 22 and radially extending blades 24 which are integrally formed with the hub 22. Any form and/or design of blade 24 and rotor 20 is contemplated. FIG. 3 also shows some blades 24 with an abrasive coating 36 disposed on tips 25.

Figure 4:
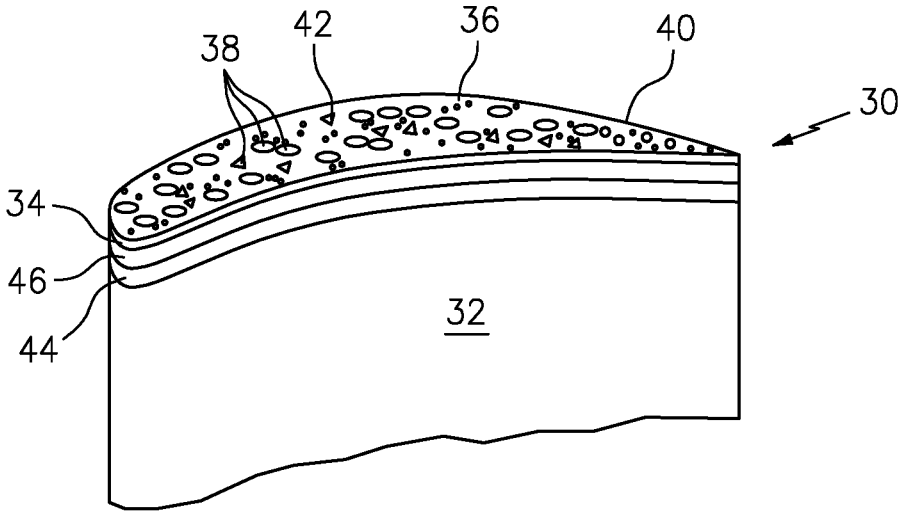
FIG. 4 is a schematic representation of an abrasive coating applied to a tip of a turbine engine component.

Referring now to FIG. 4 there is illustrated a portion of a blade 24 which in this exemplary embodiment is a blade of a gas turbine engine. The illustrated portion is the radially outward portion, which extends radially away from the hub of a rotor as illustrated in FIG. 3. Blade 24 has an airfoil or blade portion 32 and a tip 34. Abrasive coating 36 is applied to tip 34. Tip 34 can have any suitable shape and configuration. These coated tips are referred to herein with reference numeral 34 to distinguish them from the blade tips generally, which are referred to herein as reference numeral 25 (See FIG. 2).

Blades 24 may be formed from a titanium-based base material, a nickel-based base material, an iron-based base material, other alloy-based base materials, or combinations of the foregoing. In an exemplary embodiment, the blades 24 include a (Ti) titanium-based alloy and/or a (Ni) nickel-based superalloy.

Any method may be used for applying abrasive coating 36 to tips 34. Further the coating can have one-size grit particles or multiple size grit particles 38, 42 embedded in a matrix 40, or can be a non-embedded grit coating such as zirconia or aluminum oxide.

Abrasive coating 36 can optionally include a base layer 44 bonded to blade tip 34. Base layer 44 can be the same material as matrix 40. Base layer 44 can be applied using any known method for applying thin layers or coatings to tips 34 of blades 24. Base layer 44 is generally not needed for abrasive coatings based on CBN. When the abrasive layer is to be based on alumina or zirconia, the base layer can be useful to help in bonding. Base layer 44 can include grit if desired, but such grit must be small in size in order to not interfere with good bonding of the abrasive coating to the blade tip.

Base layer 44 can also have no grit, in which case thickness of base layer 44 must be less than the difference between the worn radius $R_2'$ and base radius R of the first subset of blades. Otherwise, the coating would not maintain desired abrasiveness through the useful lifetime of the rotor.

An adhesion layer 46 comprising plating, vapor deposited, brazed, cold sprayed, laser cladded, sprayed or other application process material utilized in matrix 40 can be applied to base layer 44 (or directly to blade tip 34 if the optional base layer is not applied). Adhesion layer 46 prepares the surface of tip 34 for grit particles to adhere them to tips 34.

The matrix that encompasses the grit can be formed from Al, Ni, or MCrAlY, where M is Ni, Co or a combination thereof. Adhesion layer 46 can comprise the same basic material as matrix 40 as set forth above, or other beneficial material or materials that bind the grit particles to blade tip 34 or alternatively to base layer 44. Adhesion layer 46 can comprise the same basic material as blade tip. In an exemplary embodiment, adhesion layer 46 comprises a Ni alloy matrix material.

In an exemplary embodiment, blades 24 include a first subset of blades having tips coated with abrasive coating 36, and a second subset of blades which do not have an abrasive coating. Further, as will be discussed below, the blades with abrasive coating are configured to have a greater radius than those which are not coated, such that substantially only the first subset of blades will have contact with a corresponding seal or other abradable surface. This is desirable as the materials and application of abrasive coating can be expensive. Further, the configuration of this disclosure results in any desired abrasion of the abradable surface being carried out by some but not all of the blades, with a greater amount of abrasion per rotation of the rotor, which helps to reduce the increase in temperature which accompanies the abrasion.

The first subset of blades can be radially distributed around rotor 20 through the second subset of blades such that blades which do not have the abrasive coating are generally in close proximity to at least one blade which does have abrasive coating. The first subset of blades can be between 20% and 80%, preferably less than 50% of the total number of blade tips Referring to FIG. 5, an exemplary embodiment is shown schematically illustrating a blade of the first subset, with coating 36, and a blade of the second subset, without coating. These blades are identified in FIG. 5 by reference numerals 26, 28 respectively. Thus, blades 26 correspond to the first subset of blades, and blades 28 correspond to the second subset of blades. Various radii for these blades 26, 28 are also shown in FIG. 5, and these radii R, $R_1$, $R_2$, and $R_2'$ are measured with respect to an axis of rotation of the rotor to which blades 26, 28 are adjoined, for example the central axis of rotation 23 as shown in FIGS. 1 and 2.

Figure 5:
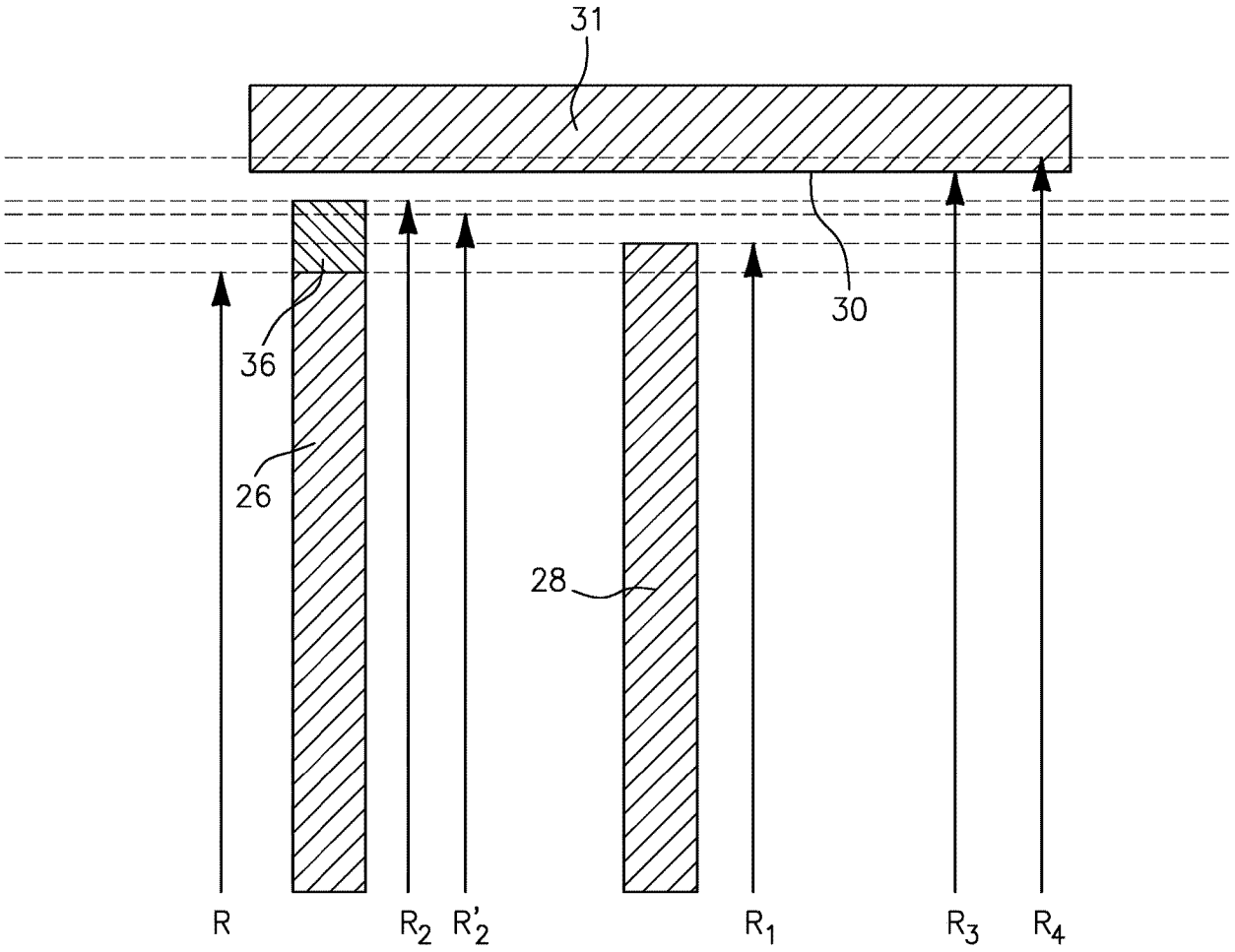
FIG. 5 is a schematic representation of blades with and without abrasive coatings and a corresponding surface or seal of abradable material.

FIG. 5 also schematically illustrates an abradable material 31 defining a surface 30 which cooperates with blades 26, 28 for purposes of sealing against gas leakage during operation as discussed above. The radii $R_3$, $R_4$ to surface 30 at different times in operation are also illustrated.

In the course of operation of a turbomachine including components 26, 28 and surface 30 of abradable material 31, it is expected for some contact or rub to occur between tips of the blades and the abradable material. This is intended as a way for the blades to form the abradable material, which typically defines a seal, to produce small clearance, and therefore, improved efficiency in operation of the turbomachine including blades 26, 28. According to this disclosure, a base radius (R) of blades 26 is smaller than a radius ($R_1$) of blades 28. However, abrasive coating 36 of tips of blades 26 defines a combined radius ($R_2$) of blade 26, including thickness of the coating, which is greater than the radius ($R_1$) of blades 28. The larger radius ($R_2$) of blades 26 causes substantially all abrading work on abradable material 31 to be performed by the abrasive coating of blades 26, thereby preventing contact or rub of the tips of blades 28, which are not protected by abrasive coating. In the course of rotation of blades 26, 28 relative to abradable material 31, blades 26 cut away a portion of the abradable material, and while so doing, a portion of the abrasive coating 36 is also removed. Thus, after an extended period of operation blades 26 may have a worn radius ($R'_2$) which is smaller than the initial combined radius ($R_2$) because of reduced thickness of the worn abrasive coating 36, but which is still greater than the radius ($R_1$) of blades 28. Further, the radius or distance ($R_3$) to the surface of abradable material 31 may increase to a larger radius ($R_4$) as abradable material is worn away.

It should be appreciated that during extended operation, abrasive coating 36 of blades 26 may be worn to an extent that worn radius ($R'_2$) of blades 26 becomes the same as radius ($R_1$) of blades 28. Even at this stage, blades 28 are still protected by blades 26 because blades 26 still have abrasive coating due to the shorter base radius (R) of blades 26 as compared to blades (28).

By providing the first subset of blades having a shorter base radius (R) but a greater overall radius ($R_2$) as compared to the non-coated blades, tips of the non-coated blades will always be in close proximity to a blade having abrasive coating such that the non-coated blade tips are always protected. Further, the shorter base radius R guarantees that non-coated blades will always be in a close proximity to a blade having abrasive coating, even after extended use and wearing off of some of the abrasive coating, for example to point where a worn combined radius ($R_2'$) is substantially the same as radius ($R_1$) of the non-coated blades.

FIG. 5 also schematically illustrates abradable material 31, for example an abradable seal 50 (see FIG. 2), opposed to blade tip 25. A surface 30 of the abradable material can be positioned at a radius ($R_3$) relative to an axis of rotation of rotor 20, which establishes a desired gap between the coated blade tips and abradable material.

In an exemplary embodiment, a starting radius ($R_3$) of surface 30 can be substantially equal to a starting radius ($R_2$) of blades having abrasive coating.

During operation, a portion of the abrasive coating will be worn away such that radius ($R_2$) of coated blades decreases to a worn down radius ($R'_2$) which nevertheless remains larger than radius ($R_1$) of blades without abrasive coating. At the same time contact occurs between abrasive coated tips 36 and abradable surface 30 such that the abradable material is worn away as intended, such that the radius of abradable surface 30 increases to a worn radius ($R_4$) as shown in FIG. 5.

The material for a suitable abrasive coating can be a robust "tipping material" such as cubic boron nitride, coated silicon carbide (SiC), or other hard ceramic phases or sprayed oxides.

Figure 7:
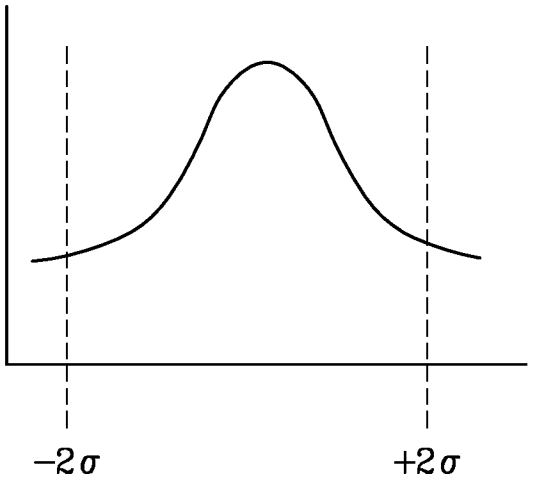
FIG. 7 shows grit size distribution for grit particles and an abrasive coating for one exemplary embodiment.

In a further exemplary embedment. Coating material can contain grit having a determined grit size distribution and an average grit size as shown in FIG. 7, falling substantially between a grit size of $-2\sigma$ and $+2\sigma$. In this regard, $\sigma$ is one standard deviation in particle size of the grit.

Figure 6:
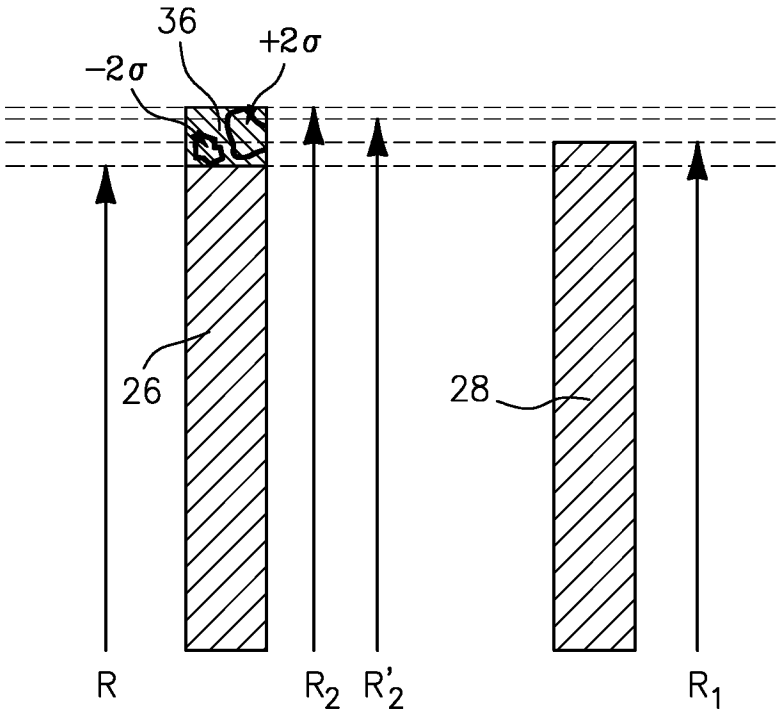
FIG. 6 is a schematic representation of tips of blades that have and do not have abrasive coatings.

The grit size is preferably selected for the system clearance dimensions such that the grit size that is $+2\sigma$ of the average grit size, when adhered to a tip of a blade 26, defines the desired combined radius ($R_2$). Further, the grit size that is $-2\sigma$ of the average grit size is such that a combined radius ($R'_2$) at a point where coating 36 is worn away from extended use, still exceeds or is at least equal to radius ($R_1$) of blades 28 with no abrasive coating. In an exemplary embodiment, values for the grit size distribution can be between about 5 microns and about 350 microns In the course of the operative life of blade 26 having a coating 36 as shown in FIG. 6, initial use of the blade would cause larger grit sizes or particles (38 in FIG. 4), corresponding to grit size of $+2\sigma$ of the average grit size, to be eroded away first, while the smaller size grit particles (42 in FIG. 4) having a grit size closer to $-2\sigma$ of the average grit size, remain in place to maintain the abrasive coating on blades 26 as desired.

In a further exemplary embodiment, the number of blades 26 in the first subset of blades of a rotor can be based on a predicted range of rub conditions during green run or break-in conditions and extreme flight envelope conditions. Specifically, the number of blades in the first subset of blades can be based upon a desired rate of abrasion of abradable material per rotation of the rotor 20. The thickness of abrasive coating 36 on blades 26 can also be related to the combination of radial velocity, axial velocity, circumferential velocity, magnitude of total radial and axial movement and diameter or the rotor and seal, again to provide a desired rate of abrasion. Within these parameters, in one exemplary embodiment, abrasive coating can have a thickness of between about 5 microns and about 350 microns In a further aspect of the disclosure, material for the abrasive coating and the abradable material, as well as the difference in radii $R_2$ and $R_3$, can be selected to define, along with the geometry of the blades and seal, a rub couple which maintains a worn radius ($R_2'$ in FIG. 5) of the first subset of blades, including remaining thickness of the abrasive coating, greater than the radius ($R_1'$) of the second subset of blades throughout a useful lifetime of the rotor.

Through the useful lifetime of the rotor, the worn radius ($R_2'$) of the first subset of blades can also be maintained greater than or equal to the worn radius ($R_4$) to the surface of the abradable material or seal.

For rotors having the same blade radius and either no abrasive coating or abrasive coating on all blade tips, abrasion of an abradable seal is conducted by all tips of the rotor. As described above, this can lead to undesirable conditions such as a large increase in temperature and, potentially, a smearing of material from the tips of the blades into the seal due to the excess temperature. Further, coating the tips of all blades consumes a large amount of expensive coating materials and still generates a large increase in temperature. By configuring only the first subset of blades, specifically blades 26, to have abrasive coating 36 for abrading the seal, as well as a larger combined radius than the blades 28 of the second subset of blades, suitable abrasion of the seal or other abradable material can be accomplished with less increase in temperature. This helps to avoid the smearing problem described above and also uses less of the expensive abrasive coating materials.

Another aspect of the disclosure is a method for making a rotor having abrasive coating on some but not all blade tips as discussed above. In this method, a rotor can start already having a first subset of blades which are shorter than the others, and abrasive coating can be applied to the tips of the shorter blades until a combined radius of the shorter blade with thickness of the coating exceeds the radius of the remaining or second subset of blades.

The method can also be applied to an existing conventional rotor having all blades of the same length, for example by machining or grinding down the tips of the number of blades which are to form the first subset of blades and be coated with abrasive coating. In this way, existing rotors can be retrofitted to include the coating configuration disclosed herein.

There has been provided a rotor for a turbomachine, which has a plurality of blades extending from a hub and having an abrasive coating on only a first subset of the blades, while the remaining or second subset of blades do not have the abrasive coating. While the disclosure has been made in the context of specific embodiments thereof, other unforeseen alternatives, modifications, and variations may become apparent to those skilled in the art having read the foregoing description. Accordingly, it is intended to embrace those alternatives, modifications, and variations that fall within the broad scope of the appended claims.

What is claimed is:

1. A rotor for a turbomachine, comprising:

a hub; and a plurality of blades extending radially from the hub, the plurality of blades comprising a first subset of blades having first tips and an abrasive coating on the first tips, and a second subset of blades having second tips with no abrasive coating on the second tips, wherein a radius ($R_2$) of the first subset of blades, including thickness of the abrasive coating, is greater than a radius ($R_1$) of the second subset of blades, and wherein a base radius (R) of the first subset of blades, not including thickness of the abrasive coating, is less than the radius ($R_1$) of the second subset of blades, wherein the abrasive coating comprises a matrix and particles of grit in the matrix, the particles having a determined grit size distribution having an average grit size, and wherein a combination of the base radius (R) of the first subset of blades and a grit particle having a particle size of $+2\sigma$ of the average grit size is substantially equal to the radius ($R_2$) of the first subset of blades including thickness of the abrasive coating.

2. The rotor of claim 1, wherein a combination of the base radius (R) of the first subset of blades and a grit particle having a particle size of $-2\sigma$ of the average grit size is greater than or equal to the radius ($R_1$) of the second subset of blades.

3. The rotor of claim 1, wherein the particles of grit are selected from the group consisting of CBN, alumina powder, zirconia powder, coated silicon carbide (SiC), ceramic powder, other hard ceramic phase, sprayed oxides and combinations thereof.

4. The rotor of claim 1, wherein the determined grit size distribution is between 5 microns and 350 microns.

5. The rotor of claim 1, wherein the rotor is a monolithic structure comprising the plurality of blades integrally formed with the hub.

6. A turbomachine comprising:

a rotor comprising a hub;

a plurality of blades extending radially from the hub, the plurality of blades comprising a first subset of blades having first tips and an abrasive coating on the first tips, and a second subset of blades having second tips with no abrasive coating on the second tips, wherein a radius ($R_2$) of the first subset of blades, including thickness of the abrasive coating is greater than a radius ($R_1$) of the second subset of blades, and wherein a base radius (R) of the first subset of blades, not including thickness of the abrasive coating, is less than the radius ($R_1$) of the second subset of blades; and an abradable surface opposed to tips of the plurality of blades, wherein the abradable surface comprises an abradable material, wherein the abrasive coating comprises a matrix and particles of grit in the matrix, the particles having a determined grit size distribution having an average grit size, and wherein a combination of the base radius (R) of the first subset of blades and a grit particle having a particle size of $+2\sigma$ of the average grit size is substantially equal to the radius ($R_2$) of the first subset of blades including thickness of the abrasive coating.

7. The turbomachine of claim 6, wherein the abradable surface has an inner radius ($R_3$) which is substantially equal to the radius ($R_2$) of the first subset of blades including thickness of the abradable coating.

8. The turbomachine of claim 6, wherein the abrasive coating and the abradable material define a rub couple which maintains a worn radius ($R_2'$) of the first subset of blades, including thickness of the abrasive coating, greater than the radius ($R_1$) of the second subset of blades through a useful lifetime of the rotor.

9. The turbomachine of claim 6, wherein a combination of the base radius (R) of the first subset of blades and a grit particle having a particle size of $-2\sigma$ of the average grit size is greater than or equal to the radius ($R_1$) of the second subset of blades.

10. The turbomachine of claim 6, wherein the particles of grit are selected from the group consisting of CBN, alumina powder, zirconia powder, coated silicon carbide (SiC), ceramic powder, other hard ceramic phase, sprayed oxides and combinations thereof.

11. The turbomachine of claim 6, wherein the determined grit size distribution is between 5 microns and 350 microns.

12. The turbomachine of claim 6, wherein the rotor is a monolithic structure comprising the plurality of blades integrally formed with the hub.

13. A method for making a rotor for a turbomachine, comprising:

providing a rotor comprising a hub and a plurality of blades extending from the hub, said plurality of blades comprising a first subset of blades having first tips and a second subset of blades having second tips, wherein a base radius (R) of the first tips is less than a radius ($R_1$) of the second tips; and applying an abrasive coating to the first tips such that a radius ($R_2$) of the first subset of blades including thickness of the abrasive coating is greater than the radius ($R_1$) of the second subset of blades, wherein the abrasive coating comprises a matrix and particles of grit in the matrix, the particles having a determined grit size distribution having an average grit size, and wherein a combination of the base radius (R) of the first subset of blades and a grit particle having a particle size of $+2\sigma$ of the average grit size is substantially equal to the radius ($R_2$) of the first subset of blades including thickness of the abrasive coating.

14. The method of claim 13, wherein a combination of the base radius (R) of the first subset of blades and a grit particle having a particle size of $-2\sigma$ of the average grit size is greater than or equal to the radius ($R_1$) of the second subset of blades.

15. The method of claim 13, wherein the particles of grit are selected from the group consisting of CBN, alumina powder, zirconia powder, coated silicon carbide (SiC), ceramic powder, other hard ceramic phase, sprayed oxides, and combinations thereof.

16. The method of claim 13, wherein the determined grit size distribution is between 5 microns and 350 microns.

17. The method of claim 13, wherein the rotor is a monolithic structure comprising the plurality of blades integrally formed with the hub.

* * * * *